US006480093B1

(12) United States Patent
Chen

(10) Patent No.: US 6,480,093 B1
(45) Date of Patent: Nov. 12, 2002

(54) COMPOSITE FILM RESISTORS AND METHOD OF MAKING THE SAME

(76) Inventor: Yang-Yuan Chen, 128 Sec. 2, Yen-Chiu-Yuan Rd, Taipei (TW)

( * ) Notice: Subject to any disclaimer, the term of this patent is extended or adjusted under 35 U.S.C. 154(b) by 0 days.

(21) Appl. No.: 09/491,446

(22) Filed: Jan. 26, 2000

(51) Int. Cl.[7] ..... H01C 1/012
(52) U.S. Cl. ..... 338/308; 338/309
(58) Field of Search ..... 338/307, 308, 338/309

(56) References Cited

U.S. PATENT DOCUMENTS

| | | | | | |
|---|---|---|---|---|---|
| 3,304,199 | A | * | 2/1967 | Faber, Sr. et al. | 428/426 |
| 3,352,797 | A | * | 11/1967 | Kim et al. | 252/514 |
| 3,439,767 | A | * | 4/1969 | Lynes et al. | |
| 3,655,440 | A | * | 4/1972 | Brady | 338/308 |
| 3,763,026 | A | | 10/1973 | Cordes | 204/192 |
| 3,966,578 | A | | 6/1976 | Sommer | 204/192 |
| 4,006,278 | A | * | 2/1977 | Pukaite | 428/427 |
| 4,183,746 | A | | 1/1980 | Pearce et al. | 75/234 |
| 4,267,074 | A | * | 5/1981 | Holmes et al. | 252/514 |
| 4,347,166 | A | * | 8/1982 | Tosaki et al. | 252/519 |
| 4,359,372 | A | | 11/1982 | Nagai et al. | 204/192 |
| 4,420,422 | A | * | 12/1983 | Ferretti | 338/308 |
| 4,424,507 | A | | 1/1984 | Nagai et al. | 338/22 R |
| 4,609,903 | A | | 9/1986 | Toyokura et al. | 338/22 SD |
| 4,906,968 | A | | 3/1990 | Gershenfeld et al. | 338/25 |
| 5,069,824 | A | * | 12/1991 | Blanke et al. | 338/308 |
| 5,122,777 | A | * | 6/1992 | Shiratsuki et al. | 338/306 |
| 5,367,285 | A | | 11/1994 | Swinehart et al. | 338/308 |
| 5,510,823 | A | * | 4/1996 | Tanaka et al. | 338/308 |
| 6,154,119 | A | * | 11/2000 | Jankowski et al. | 338/308 |
| 6,180,291 | B1 | * | 1/2001 | Bessy et al. | 430/5 |

* cited by examiner

*Primary Examiner*—Karl D. Easthom

(57) ABSTRACT

Disclosed is an electrical film resistor or a film thermistor formed by a composite of electrically-conducting oxide and electrically insulating aluminum oxide ($Al_2O_3$, the sapphire). In a preferred embodiment, the electrically-conducting oxide can be ruthenium oxide ($RuO_2$) or iridium oxide ($IrO_2$). The composite film is formed by a film deposition process such as rf sputtering deposition in the presence of an inert gas. By adjusting the composition ratio of the composite, or changing the reaction conditions of the film deposition, for example, the inert gas pressure or the substrate temperature, the composite film can be formed for applications in either electrical resistor devices or thermistors.

10 Claims, 4 Drawing Sheets

COMPOSITE FILM RESISTORS AND METHOD OF MAKING THE SAME

FIELD OF INVENTION

This invention relates to film resistors, and more particularly to film resistors formed by the composite of electrically-conducting oxide and aluminum oxide. In addition, this invention relates to resistor and thermistor devices comprising the composite film resistors.

BACKGROUND AND SUMMARY OF INVENTION

The Ohm's law, a fundamental principle of electricity, defines the resistance of a device as the ratio of the voltage to the current in an electrical circuit. There are many factors which will affect the resistance value of a device. An important factor discussed here is the temperature of a device. To investigate the characteristics of resistance versus temperature for a device, a measurement called the temperature coefficient of resistance (TCR) is defined as the variation of resistance over the variation of temperature (TCR= dR/dT). If the resistance value of a device is substantially constant with respect to its ambient temperature, that is, the TCR of the device is nearly zero, it is generally referred to as an electrical resistor device. Electrical resistor devices are essential components widely applied in electrical circuits. The shape of an electrical resistor device could possibly be a bulk, a thick film or a thin film. Typical materials used for electrical resistor devices include alloys such as manganin and constantan, as well as graphite-based materials.

In contrast, a temperature-variant resistor could be referred to as a thermistor. A thermistor is an electrical device with a non-zero and large value,of TCR in order to have sensitive resistance variation in response to a temperature change. Thermistor devices having positive TCR, of which resistance increases as the temperature increases, can be used as temperature sensors. High-purity metals like platinum are typical materials for positive TCR thermistors. However, these metals are not useful at low temperatures, where their TCR will approach zero because of impurity effects. The low-temperature difficulty is overcome by semiconductor thermistors that have negative TCR values. Conventional materials of semiconductor thermistors include carbon and germanium.

Similar to resistor devices, thermistors can be in the shape of a bulk, a thick film or a thin film. However, while a thermistor is incorporated into a compact device such as a temperature sensor, the limitation of the thermistor's physical geometry becomes critical such that thin film thermistors are needed. Other merits of thin film thermistors include their fast thermal responses because of their small thermal masses. There are many thin film thermistors that have been developed. One of the well-known thin film thermistors is formed of a film having metal precipitates in insulating matrices, for example, a film of platinum particles in alumina. This approach has the drawback in difficulty of control during the formation of the film. Other conventional materials for thin film thermistors include common semiconductors such as doped silicon or germanium, but such thermistors are known to be unsuitable for in-fields measurement for their large magneto-resistance. In a more recent method described in U.S. Pat. No. 5,367,285 to Swinehart et al., a film resistor comprising an alloy of both an electrically-insulating oxide and an electrically-conducting nitride of at least one metal is formed by reactive sputtering. By adjusting the volume ratio of the oxygen-containing gas to the nitrogen gas, a desired oxide to nitride ratio and thus, a desired TCR value, can be achieved. However, this method requires a precise control for the volume ratio of reactive gasses and therefore, is difficult and complicated in the fabrication process.

There is, thus, a need to provide an easy and simple method for manufacturing thin film electrical resistors and/or thermistors which are insensitive to magnetic fields for in-field applications. This invention addresses the need.

The present invention relates to film resistors formed by a composite of both electrically-conducting oxide and electrically-insulating aluminum oxide ($Al_2O_3$),wherein the electrically-conducting oxide can be ruthenium oxide ($RuO_2$) or iridium oxide ($IrO_2$). In particular, a resistor device of this invention comprises an insulating substrate, a composite film formed of the electrically-conducting oxide and electrically-insulating aluminum oxide and at least two electrodes formed on the composite film.

The composite film is formed by a film deposition process such as non-reactive sputtering deposition with either one target comprised of the mixture of both oxides, or two separate targets respectively made of pure electrically-conducting oxide and pure $Al_2O_3$, in an inert gas. By varying the composition ratio of the electrically-conducting oxide and $Al_2O_3$ composite, or by adjusting the process parameters of the film deposition such as the inert gas pressure and the substrate temperature, the composite film can have a desired TCR value. Consequently, either an electrical resistor device or a thermistor device can be formed.

In addition to the above-mentioned advantages, the composite film resistors are mechanically resilient and thermally stable such that they are greatly suitable for practical use.

BRIEF DESCRIPTION OF DRAWINGS

The present invention now will become better understood with regard to the accompanying drawings in which.

DETAILED DESCRIPTION OF INVENTION

A preferred embodiment of the present invention will be now described below with reference to the accompanying drawings. In this embodiment, the electrically-conducting oxide is particularly, the ruthenium oxide ($RuO_2$). Other embodiment using iridium oxide ($IrO_2$) as the electrically-conducting oxide can be discussed in a similar way.

Many well-known film deposition techniques can be employed for the fabrication of the $(RuO_2)_x(Al_2O_3)_{1-x}$ film resistors in this invention, for example, rf sputtering, ion and ion-assisted sputtering, reactive evaporation, pulse laser deposition, chemical vapor deposition, metal-organic chemical vapor deposition, and molecular beam epitaxy. Preferably, the rf sputtering is applied for reasons of convenience and cost. The embodiments described below are examples of manufacturing the film resistors by rf sputtering.

First, an electrically-insulating substrate is prepared for the fabrication process. Preferably, the substrate is optic-polished, single-crystal $Al_2O_3$ of arbitrary orientations because of its capability of better matching the film resistors both chemically and physically. The substrate is preheated in a chamber which is in a high vacuum of $1\times10^{-7}$torr for three hours to clean the surface of the substrate, then the temperature of the substrate is slowly decreased to 300° C. Preferably, the vacuum chamber is equipped with one or two sputtering magnetrons and the substrate is placed 3–5 cms from the magnetrons. A particularly designed mask can also be placed over the substrate to obtain a desired sputtering pattern of the film resistor. After preheating, the vacuum chamber is filled with argon gas of a 99.999% purity by adjusting both pump throttle valve and argon gas inlet valve to set up the argon flow at a desired gas pressure of $3.6\times10^{-2}$ torr. As for the target of the sputtering deposition, there could be either one target comprised of the mixture of $(RuO_2)_x(Al_2O_3)_{1-x}$ at some composition ratio x, or two separate targets of pure $RuO_2$ and pure $Al_2O_3$, respectively, with different sputtering rates, to serve the purpose of forming a composite film of $(RuO_2)_x(Al_2O_3)_{1-x}$. Before sputtering, the target would be pre-sputtered for several hours with a shutter temporarily placed between the target and the substrate in order to establish a stable plasma with an equilibrium composition. After finishing pre-sputtering, the shutter will be removed to begin the sputtering deposition. In this embodiment, it will take about 5–10 hours to deposit a $(RuO_2)_x(Al_2O_3)_{1-x}$ film of thickness 3000–4000 Å On the substrate.

Figure 1:
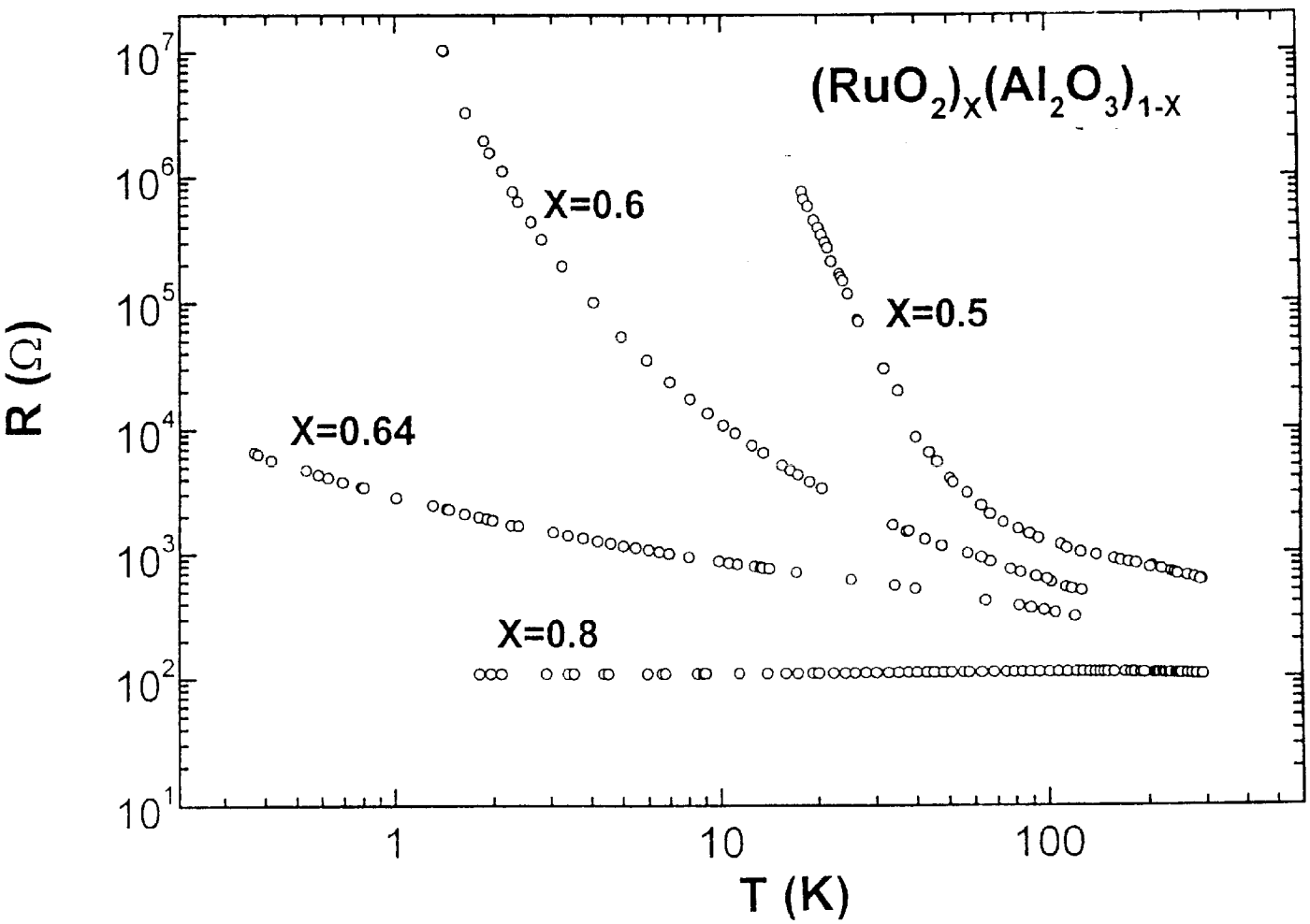
FIG. 1 is a graph showing the temperature T dependence of resistance R (both T and R in logarithm scale) for $(RuO_2)_{1-x}(Al_2O_3)_x$ film resistors of various compositions according to a preferred embodiment of the invention.
Figure 2:
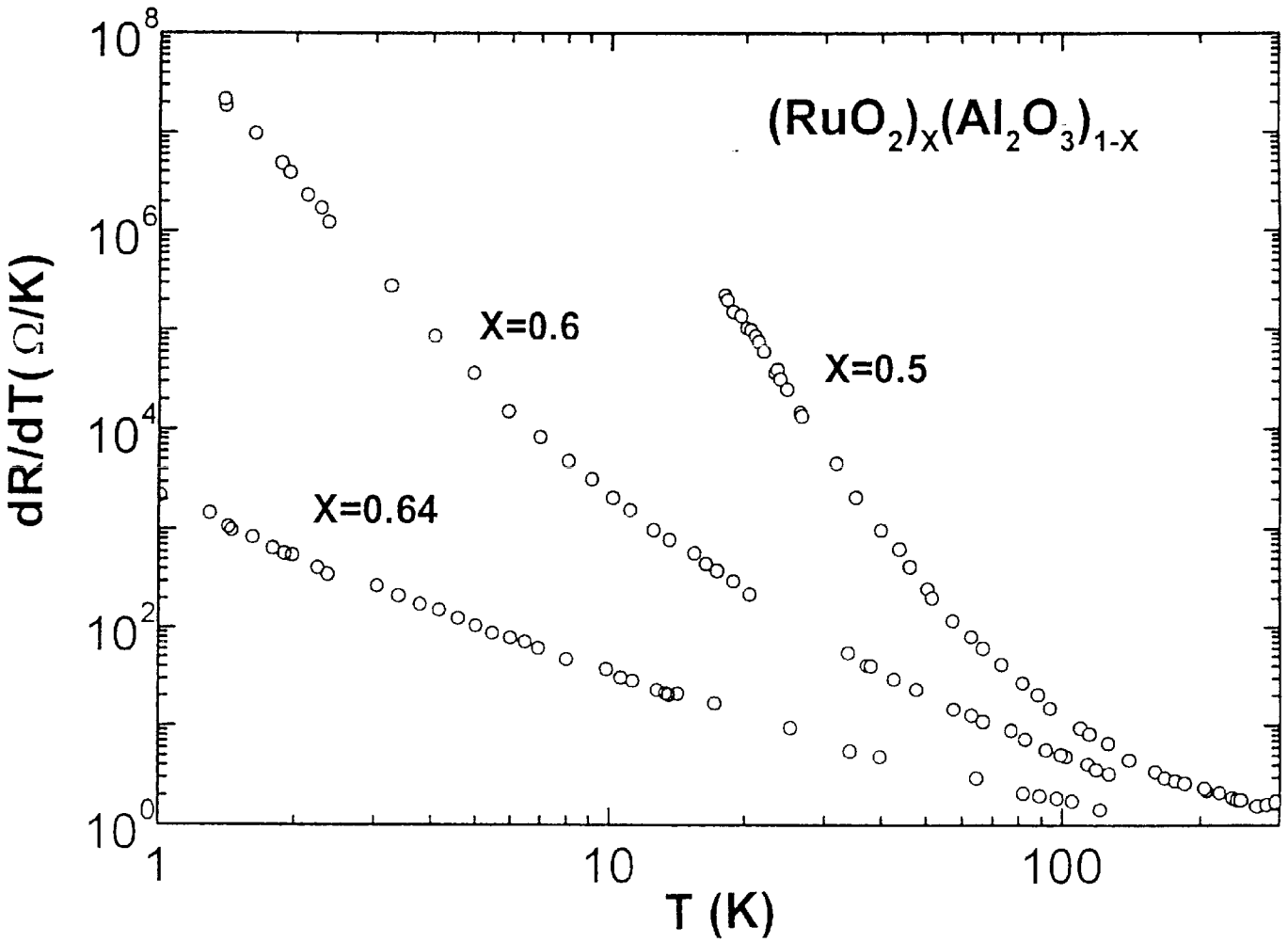
FIG. 2 is a graph showing the temperature T dependence of the temperature coefficient of resistance TCR=dR/dT (both T and TCR in logarithm scale) for $(RuO_2)_x(Al_2O_3)_{1-x}$ film resistors of various compositions according to a preferred embodiment of the invention.

Referring to FIGS. 1 and 2, four compositions of film resistors $(RuO_2)_x(Al_2O_3)_{1-x}$ having x=0.8, 0.64, 0.6 and 0.5 are fabricated and analyzed. As mentioned before, the composite film resistors of this invention comprises electrically-conducting ruthenium oxide ($RuO_2$) and electrically-insulating sapphire ($Al_2O_3$), and the most relevant measurements determining the different applications of the resistors, as either electrical resistor devices or thermistor devices, include their resistance R versus T, and their temperature coefficient of resistance TCR=dR/dT. The resistance R is related to the geometry of the device and the following values of R for each device are measured based on a fixed geometry by a four probe method. However, TCR is an intrinsic property independent of a resistor's geometry. As shown in FIG. 1, when x equals to 0.8, the resistance value R of $(RuO_2)_{0.8}(Al_2O_3)_{0.2}$ is substantially constant over a wide range of temperature (note that T is in logarithm scale and ranges from 1.4 K to room temperature.) Under this circumstance, the TCR=dR/dT will be nearly zero because the resistance R is constant. It could be concluded that $(RuO_2)_{0.8}\cdot(Al_2O_3)_{0.2}$ is suitable for the applications in electrical resistor devices in which resistance is required to be fixed.

If the film resistor is used in thermistor devices, its TCR should be high for sensitivity. Therefore, except for the x=0.8 case, $(RuO_2)_x(Al_2O_3)_{1-x}$ films with x=0.64, 0.6 and 0.5 are suitable for application in thermistor devices because of their temperature-dependent resistance (i.e. non-zero TCR value).

The above results could be interpreted such that, with a higher composition ratio x of electrically conducting $RuO_2$ in the composite film (e.g. x=0.8), the film will be similar to a pure metal or alloy of which resistivity remains substantially constant. On the contrary, as the composition ratio (1−x) of electrically-insulating $Al_2O_3$ increases, the composite film will have higher. resistance and larger TCR values (e.g. x=0.64, 0.6 or 0.5).

Figure 3:
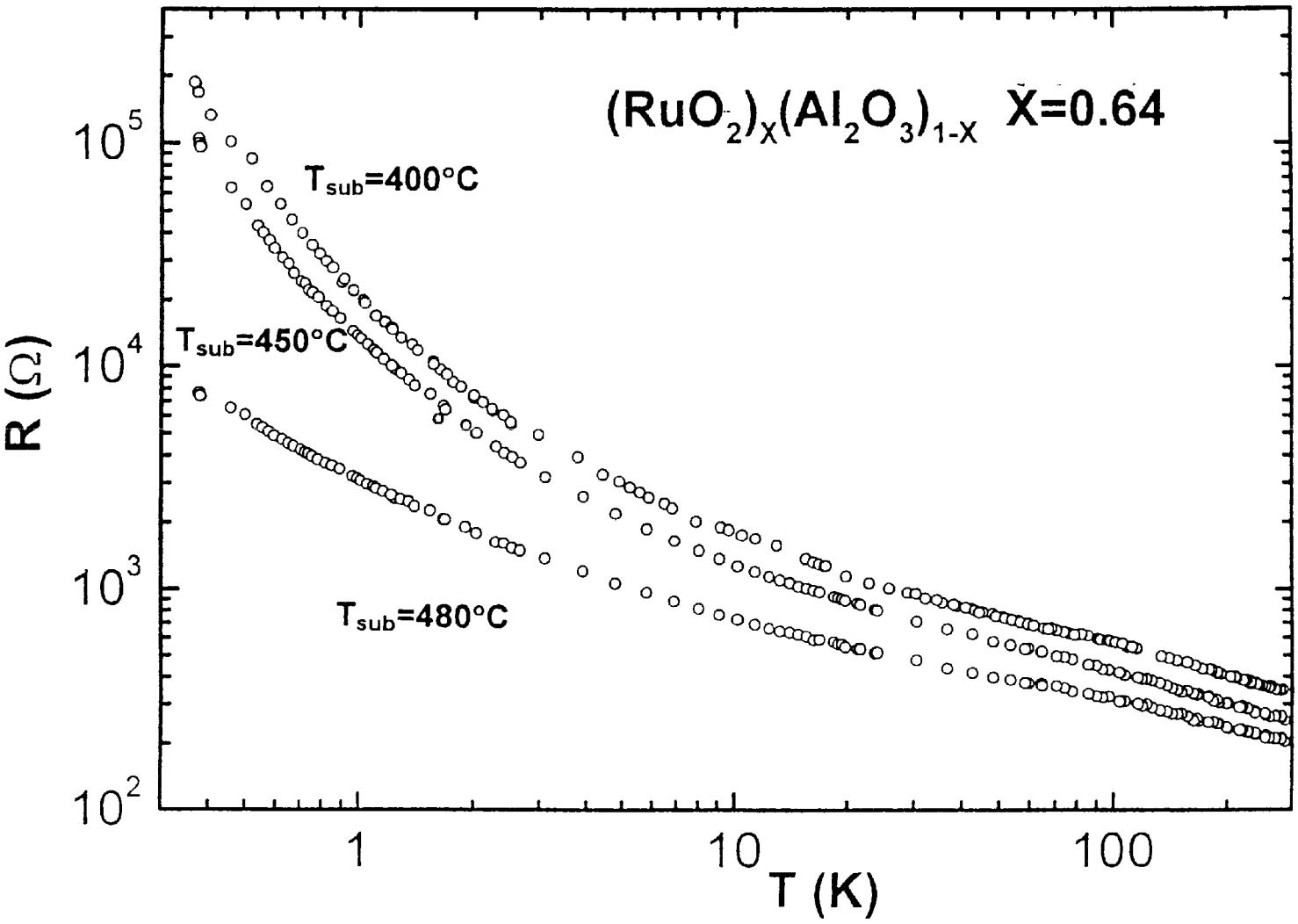
FIG. 3 is a graph showing the temperature T dependence of resistance R (both T and R in logarithm scale) for $(RuO_2)_x(Al_2O_3)_{1-x}$ film resistors fabricated at various substrate temperatures $T_{sub}$S where x equals 0.64 according to a preferred embodiment of the invention.

The substrate temperature of the film resistor while being fabricated would also affect its temperature-resistance characteristics. During sputtering deposition, normally the substrate temperature $T_{sub}$ could be in a range of 20° C. to 500° C. With reference to FIG. 3, there are three different substrate temperatures ($T_{sub}$=400, 450 and 480° C.), respectively, in the three fabrication processes of the $(RuO_2)_{0.64}(Al_2O_3)_{0.36}$ films. Basically, it can be concluded from the result of FIG. 3 that a lower substrate temperature will result in higher resistance and greater TCR values, with all other processing parameters remaining unchanged.

Although argon gas is used in the sputtering process of the embodiment, it can be replaced with any other inert gas including neon, xenon or krypton.

Figure 4:
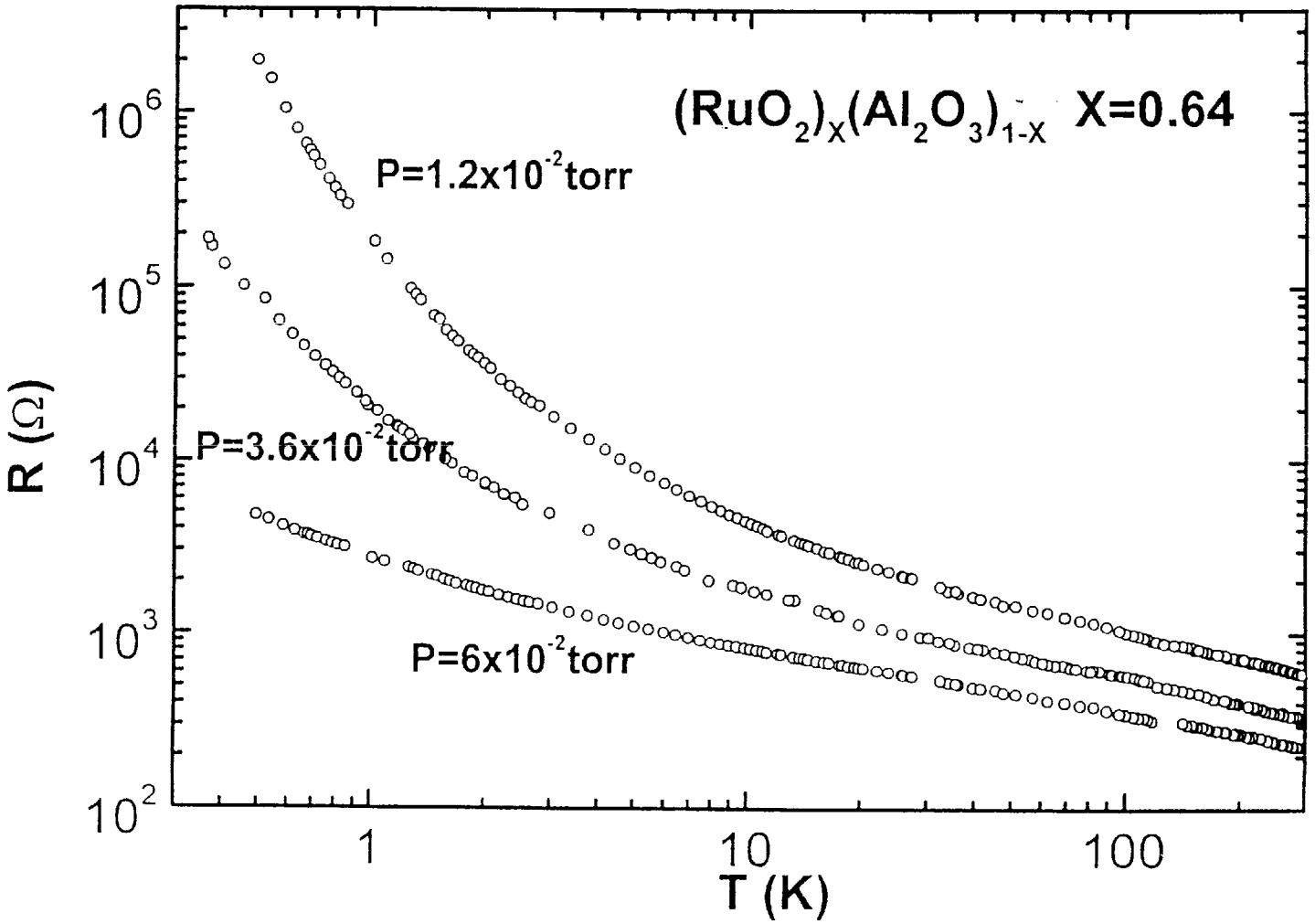
FIG. 4 is a graph showing the temperature T dependence of resistance R (both T and R in logarithm scale) for $(RuO_2)_x(Al_2O_3)_{1-x}$ film resistors fabricated under various argon pressures where x is equal to 0.64 according to a preferred embodiment of the invention.

The inert gas pressure P during sputtering deposition can be in a range of $1\times10^{-4}$ torr to $1\times10^{-1}$ torr, as long as a sputtering plasma can be initiated. Referring to FIG. 4, three different gas pressures ($P=1.2\times10^{-2}$, $3.6\times10^{-2}$ and $6\times10^{-2}$ torr) are applied, respectively, in the three fabrication processes of the of $(RuO_2)_{0.64}(Al_2O_3)_{0.36}$ films. Generally speaking, a lower inert gas pressure will result in higher resistance and greater TCR values, with all other processing parameters remaining unchanged.

In the embodiment, a substrate of optic-polished single crystals of sapphire ($Al_2O_3$) with arbitrary orientation is used for its good matching capability. Other electrical insulators can also be used as the materials for substrate.

Furthermore, in conjunction with the application as thermistor or electrical resistor devices, the composite film of this invention will be deposited on at least a pair of electrical contacts or electrodes for the connection to the film. Suitable materials for forming the electrodes include Au, Cu, Pt, Ni, Cr, Ti and $RuO_2$ From the foregoing, it will be apparent that by adjusting the composition ratio of the composite, or the reacting conditions of film deposition such as the inert gas pressure or the substrate temperature, the composite $(RuO_2)_x(Al_2O_3)_{1-x}$ film having different TCR values can be fabricated. That is, either a thermistor or an electrical resistor device can be fabricated accordingly. The films of this invention are not only mechanically resilient, but also thermally stable at elevated temperatures. The films are capable of in-field application for their insensitivity to magnetic fields. Another important issue on application is the fact that the film resistors of this invention can have near-zero or non-zero TCR values.

The above-mentioned fabrication processes can be also be applied in a similar way to manufacturing the composite $(IrO_2)_x(Al_2O_3)_{1-x}$ film according to another preferred embodiment of the present invention.

From the invention thus described, it will be obvious that the embodiments and description are not indeed to limit the invention. The invention may be varied in many ways. Such variations are not to be regarded as a departure from the spirit and scope of the invention, and all such modifications as would be obvious to one skilled in the art are intended for inclusion within the scope of the following claims.

What is claimed is:

1. A film resistor comprising a composite film consisting of an electrically insulating aluminum oxide and an electrically conducting ruthenium oxide, the composite film being characterized by the formula $(RuO_2)_x(Al_2O_3)_{1-x}$ wherein x ranges from 0.5 to 0.8.

2. The film resistor of claim 1, wherein the composite film is characterized by the formula $(RuO_2)_{0.8}(Al_2O_3)_{0.2}$.

3. The film resistor of claim 1, wherein the composite film is characterized by the formula $(RuO_2)_{0.64}(Al_2O_3)_{0.36}$.

4. The film resistor of claim 1, wherein the composite film is characterized by the formula $(RuO_2)_{0.6}(Al_2O_3)_{0.4}$.

5. The film resistor of claim 1, wherein the composite film is characterized by the formula $(RuO_2)_{0.5}(Al_2O_3)_{0.5}$.

6. A resistor device comprising:

an electrically insulating substrate;

a composite film formed on a surface of the substrate, said composite film consisting of an electrically insulating aluminum oxide and an electrically conducting ruthenium oxide, the composite film being characterized by the formula $(RuO_2)_x(Al_2O_3)_{1-x}$, wherein x ranges from 0.5 to 0.8; and at least two electrodes formed on the composite film to provide electrical connection to the composite film.

7. The resistor device of claim 6, wherein the composite film is characterized by the formula $(RuO_2)_{0.8}(Al_2O_3)_{0.2}$.

8. The resistor device of claim 6, wherein the composite film is characterized by the formula $(RuO_2)_{0.64}(Al_2O_3)_{0.36}$.

9. The resistor device of claim 6, wherein the composite film is characterized by the formula $(RuO_2)_{0.6}(Al_2O_3)_{0.4}$.

10. The resistor device of claim 6, wherein the composite film is characterized by the formula $(RuO_2)_{0.5}(Al_2O_3)_{0.5}$.

* * * * *